US008281726B2

(12) United States Patent
Brunner et al.

(10) Patent No.: US 8,281,726 B2
(45) Date of Patent: Oct. 9, 2012

(54) HOLDING DEVICE FOR A TOOL FOR PROCESSING A TEXTILE OR NON-TEXTILE SHEET MATERIAL FOR A SEWING MACHINE

(75) Inventors: Severin Brunner, Steckborn (CH); Dusan Dunjic, Steckborn (CH); Markus Muller, Fruthwilen (CH)

(73) Assignee: Bernina International AG, Steckborn (CH)

( * ) Notice: Subject to any disclaimer, the term of this patent is extended or adjusted under 35 U.S.C. 154(b) by 236 days.

(21) Appl. No.: 12/700,789

(22) Filed: Feb. 5, 2010

(65) Prior Publication Data

US 2010/0199900 A1 Aug. 12, 2010

(30) Foreign Application Priority Data

Feb. 11, 2009 (CH) ..... 0204/09

(51) Int. Cl.
*B65H 59/00* (2006.01)

(52) U.S. Cl. ..... 112/270

(58) Field of Classification Search ..... 112/270, 112/470.04, 196, 221, 227, 235, 240
See application file for complete search history.

(56) References Cited

U.S. PATENT DOCUMENTS 4,077,340 A * 3/1978 Braun et al. ..... 112/131
5,188,047 A * 2/1993 Rohr et al. ..... 112/470.03
7,836,838 B2 * 11/2010 Makino et al. ..... 112/470.01

FOREIGN PATENT DOCUMENTS

JP 07133575 5/1995

* cited by examiner

*Primary Examiner* — Tejash Patel
(74) *Attorney, Agent, or Firm* — Volpe and Koenig, P.C.

(57) ABSTRACT

A holding device (3) for a tool, e.g., a textile marker (5), for the processing of a textile or non-textile sheet material (44) is attached to the presser foot bar (23) of a sewing machine (1). The tool is supported by a tool holder (15) so that it can move on a base part (19) of the holding device (3) and can be changed in its position or activation through movements of the needle bar (9) of the sewing machine (1).

10 Claims, 3 Drawing Sheets

HOLDING DEVICE FOR A TOOL FOR PROCESSING A TEXTILE OR NON-TEXTILE SHEET MATERIAL FOR A SEWING MACHINE

CROSS-REFERENCE TO RELATED APPLICATIONS

This application claims the benefit of Swiss Patent Application No. 00204/09, filed Feb. 11, 2009, which is incorporated herein by reference as if fully set forth.

BACKGROUND

The invention is directed to a holding device for a tool for processing a textile or non-textile sheet material for a sewing machine and a method for processing the sheet material with such a tool.

Sewing machines and embroidery machines each comprise a stitch-forming device for creating seams or embroidery patterns in a textile sheet material or sewing material. Here, the sewing material is moved or shifted step by step in a plane underneath a sewing machine head. The sewing needle is detachably connected to a needle holder arranged on the lower end of a needle bar. The needle bar projects at the bottom from the machine head and can be moved up and down by a needle bar drive in the axial direction, such that the sewing needle can perform sewing stitches. At a small distance, a presser foot bar projects parallel to the needle bar at the bottom on the machine head. As a rule, it comprises a conical or tapering, pointed lower end for coupling and mounting various presser feet. Each of the presser feet comprises a shaft corresponding to the conical end of the presser foot bar and thus can be easily placed on the presser foot bar from below. In this way, the presser foot is automatically centered and optionally brought through additional alignment means into a specified desired position. It can be fixed there, e.g., by a holding clip or other attachment element. Such presser feet are known in various embodiments—each according to the type of stitches to be performed. For sewing, the presser foot bar is lowered with the presser foot, such that the presser foot bar contacts the material to be sewn. The presser foot bar is pressed downward by the force of a spring, so that the presser foot base is pressed elastically onto the top side of the material to be sewn. The sewing needle with the upper thread is pierced into the material to be sewn at least approximately vertical to the plane of the material to be sewn and is pulled out again in the opposite direction. The material being sewn can be shifted, e.g., by a feeder, into the new position required for the next sewing stitch before this next sewing stitch is performed. Alternatively, the material to be sewn could also be tensioned in an embroidery hoop. Through the use of an x-y motion device, the embroidery hoop is shifted step by step, such that the next piercing position of the material being sewn comes to lie under the sewing needle. The movements of the embroidery hoop are controlled by the sewing machine controller or alternatively by a PC or by an external controller and are performed coordinated with the stitch movements of the needle bar. In the case of another alternative application, e.g., darning or quilting, the sewing material is shifted manually in the plane of the sewing material. These techniques are assumed to have been known for a long time.

It is also known to use different tools for processing the material to be sewn instead of sewing needles. Thus, for example, instead of a single sewing needle or multiple sewing needles, a cutting needle could also be attached to the needle bar, wherein this cutting needle could be used for cutting the sewing material.

From JP7133575, another alternative application of a sewing machine for the point-by-point application of inks on a piece of cloth or paper is known. The textile or non-textile, sheet material is here tensioned in an embroidery hoop or held by this hoop and can be shifted in the sewing plane underneath the needle bar by the x-y drive of this hoop. A plotter pen or ink stamp is mounted rigidly on the lower end of the presser foot bar. Driven by a hopper mechanism, the presser foot bar with the plotter pen or the stamp can be lowered onto the material to be sewn and lifted again. Just like for embroidery, the material being sewn is shifted step by step according to the print pattern to be created. Instead of the construction of sewing stitches by a sewing needle held on the needle bar, however, image points are created by lowering and raising or lifting the presser foot bar onto or from the sewing material.

One disadvantage of this method lies in that this device can be used only for specially equipped sewing machines. In addition, the stroke of the hopper mechanism is relatively small. This can lead to problems especially in the case of thick cloths or in the case of several cloth layers.

SUMMARY

Therefore, one objective of the present invention is to create an improved device and a simple method for the deposition of inks on sheet materials using arbitrary, commercially available sewing machines. Another objective of the invention is to construct the device and the method such that commercially available textile markers or plotter pens can be used for applying the inks or printing on the sheet material. Another objective of the invention consists in constructing the device and the method such that, instead of plotter pens, other processing tools could also be used and that, instead of applying inks—corresponding to the tools being used—the sheet material can also be processed in other ways.

These objectives are met by a holding device for a tool and by a method for processing a textile or non-textile, sheet material according to the features of the invention.

The holding device according to the invention is attached to the presser foot bar of the sewing machine analogous to a commercially available presser foot. The holding device comprises a tool holder for holding and attaching a commercially available textile marker or alternatively a different tool. The tool holder can pivot on a base part or can be moved guided in a different way or held so that it can shift. If the holding device is attached to the presser foot bar, the needle bar or a transmission part connected to the needle bar, such as, e.g., the needle holder, is led into contact with a coupling element on the tool holder when it is lowered or when a stitching movement is performed. Through the action of the force of the needle bar or the transmission part on the coupling element, the tool holder with the tool performs a movement corresponding to the degree or degrees of freedom of motion specified by the guide. Advantageously, the tool holder is spring-loaded such that it is held in a home position on the base part without the action of additional forces on the side of the needle bar or returns to this home position when the action of the force of the needle bar is stopped. In the case of a preferred construction of the invention, the holding device is constructed so that the tool holder is shifted downward against the spring force of a restoring spring by a few millimeters guided parallel to the presser foot axis when the lower end of the needle bar or a transmission element held on this needle bar, such as, e.g., a part of the needle holder, meets a region of the tool holder designated as a coupling element in the case of downward movement shortly before the lower reversal point. Advantageously, the transmission element comprises a shock absorber or an elastically resilient element, such as, e.g., a spring, in order to dampen or cushion the impacts of the needle bar. For moving the tool holder and thus also the tool attached to this holder, the movement of the needle bar could also be used, as is otherwise provided in the case of conventional sewing or embroidery processes. As an alternative or addition to the axial movement of the needle bar, a pivoting motion of the needle bar, as is conventionally used in the case of zigzag stitches, could also be used for transferring movement to the tool holder.

In the case of a preferred construction of the holding device, the tool holder is constructed for holding commercially available textile markers. It could comprise, e.g., exchangeable adapters for fixing such markers in a defined position, such that the marker tip lies at the intersection point of the marker axis and the needle bar axis and that, instead of piercing points of the sewing needle, ink points of the textile marker are formed on the sewing material. Alternatively, the tool holder or the adapter could also be constructed so that the marker tip of the textile marker is arranged somewhat radially offset relative to the extended needle bar axis. In this case, it is possible, even in the case of a sewing needle inserted into the needle holder, to form ink points in parallel and offset to the sewing stitches with the textile marker on the sewing material. The tool holder is advantageously formed so that the axis of the textile marker fixed in this holder is arranged inclined relative to the needle bar axis. In this way, the length of the textile marker that can be used is not limited by the distance between the machine head and the sewing material. For the use of multiple needles or for a marker tip of the textile marker arranged radially offset relative to the needle bar axis, it is possible to simultaneously print on a sheet material during a sewing or embroidery process. In this case, the sewing needle remains inserted in the needle holder during the processing of the sheet material. Optionally, the holding device could comprise an adjustment mechanism that allows the limitation of the range of movement of the tool holder. With the adjustment mechanism, for example, boundaries can be set for the positions of the home position and/or the final position of the tool holder with respect to the base part. In this case, the adjustment mechanism could be used, e.g., for adapting the height of the textile marker relative to the sheet material to be processed.

In general, the adjustment device could comprise means for setting the mutual position of two objects that can move relative to each other, wherein at least one of these objects is an element of the holding device. Examples of such object pairs are presser foot bar-base part, base part-tool holder, tool holder-adapter (for tool); tool holder-tool.

The holding device or an adapter for attaching the tool on the tool holder could be constructed so that the tool can be attached at different positions relative to the base part. Thus, for example, a textile marker could be attached to the sewing machine at different inclination angles relative to the needle bar axis by the holding device.

One essential advantage of the invention lies in that the holding device could be connected to nearly any sewing machine instead of a conventional presser foot, and that, as a rule, no other adaptations for this purpose are required on the side of the sewing machine. The height or position of the holding device on the presser foot can be specified fixed or alternatively adjustable. In the case of different configurations of a sewing machine, the holding device could be used with or without an active feeder or embroidery hoop. For processing a textile, sheet material with the tool held in the holding device, different operating modes of the sewing machine can be used. In particular, the tool could be operated analogous to a sewing process with cyclical movements of the needle bar. The sheet material could here be shifted automatically in sync with the needle bar movement by the corresponding transport device or manually relative to the tool. The needle bar does not absolutely have to perform cyclical movements. For example, it could be temporarily decoupled from the driving main shaft or it could be brought into specified positions by corresponding control of the main shaft movement. In particular, a textile marker could be lowered as a tool into a work position through a half rotation of the main shaft. In this work position, the marker tip lies on the sheet material. By shifting the sheet material, drawn-out lines can be created on the sheet material. Then the tool is lifted back into a home position by another half rotation of the main shaft. Advantageously, the controller is constructed so that the movements of the needle bar and the sewing material can be controlled independently from each other. In the case of an especially preferred variant, the rates of movement of the embroidery hoop and/or the needle bar can also be controlled by the controller. Through different action times of the textile marker on the sheet material, the appearance of the created lines can be changed. Through a soft and gentle setting of the marker tip on the sheet material, the formation of spots at the starting point of lines can be prevented. In addition, the service life of the textile marker increases.

BRIEF DESCRIPTION OF THE DRAWINGS

With reference to the figures, an exemplary embodiment of the invention will be described in more detail below. Shown here are.

DETAILED DESCRIPTION OF THE PREFERRED EMBODIMENTS

Figure 1:
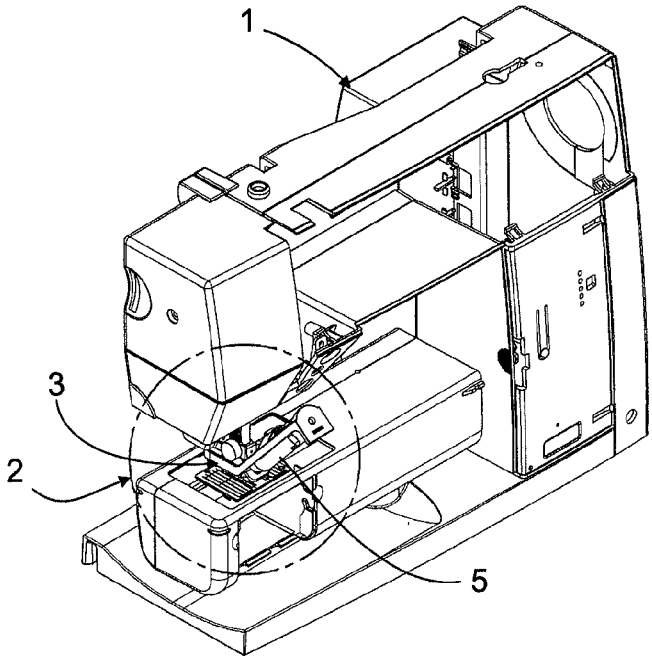
FIG. 1 is a perspective view of a partially cut-away sewing machine with holding device attached to this sewing machine for a textile marker.
Figure 2:
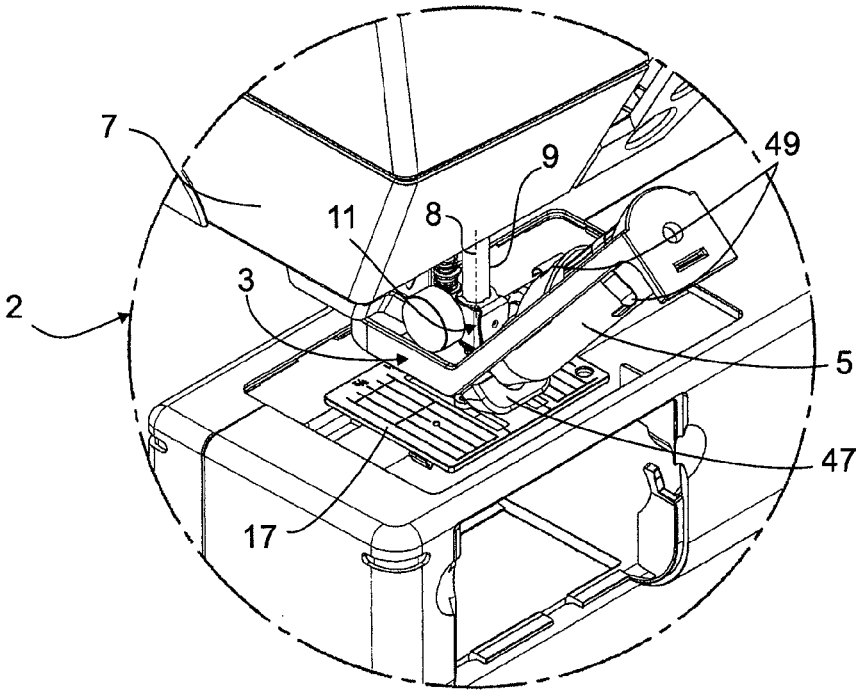
FIG. 2 is a detail view of the sewing machine circled in FIG. 1 with a circle 2 in the region of the holding device with the textile marker.
Figure 3:
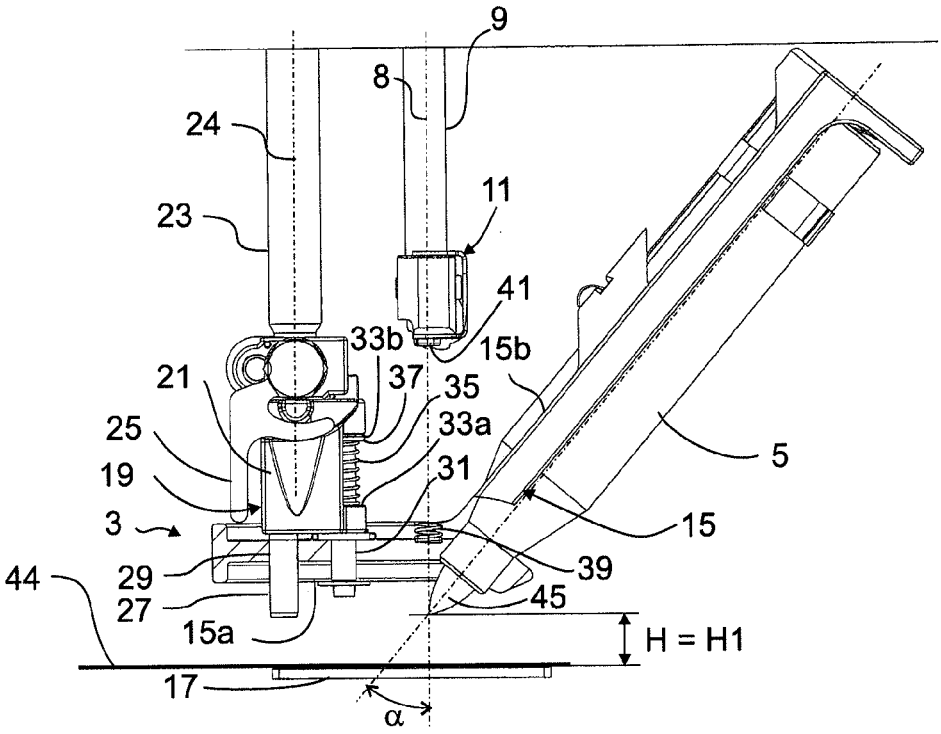
FIG. 3 is a side view of the arrangement from FIG. 1 in the region of the holding device in a first operating position.

FIG. 1 shows a partially cut-away sewing machine 1 with a holding device 3 attached to the sewing machine for a textile marker 5. The partial region circled by a circular line 2 is shown enlarged in FIG. 2. At the bottom on the sewing machine head 7, a needle bar 9 projects that can be moved up and down by a needle bar drive in the vertical direction or in the direction of the needle bar axis 8. At the lower end of the needle bar 9, a needle holder 11 for the detachable attachment of a sewing needle 13 (FIG. 5) is connected rigidly to the needle bar 9. The textile marker 5 is held in a tool holder 15 of the holding device 3 such that its marker tip is arranged directly in the extension of the needle bar axis 8 or slightly radially offset relative to this axis above the stitch plate 17. FIG. 3 shows the arrangement from FIG. 1 in a partially cut-away side view. The holding device 3 comprises a base part 19 with a presser foot shaft 21 for the attachment on the usually conical lower end of a presser foot bar 23. The base part 19 is connected rigidly to the presser foot bar 23 analogous to a presser foot, e.g., by an attachment lever 25. The base part 19 comprises a first guide bolt 27. If the holding device 3 is attached to the presser foot bar 23, the first guide bolt 27 projects parallel to the presser foot bar axis 24 downward into a corresponding first borehole 29 on a first leg 15*a* of the tool holder 15 oriented parallel to the stitch plate 17. On this first leg 15*a*, a second guide bolt 31 projects parallel to the first guide bolt 27 upward into a corresponding second borehole (not visible) on the base part 19. The first borehole 29 and the second borehole are constructed as bearings for the corresponding guide bolts 27, 31. Instead of round guide bolts 27, 31, other linear guide elements and correspondingly adapted bearings could also be provided. Perpendicular to the second borehole, on the base part 19 a recess is formed that exposes the second borehole in a middle section of the base part 19 and exposes, adjacent to the second borehole, a lower contact face 33*a* and an upper contact face 33*b* on the base part 19. Between the two contact faces 33*a*, 33*b*, a coil spring 35 is held between the lower contact face 33*a* and a limiting element, e.g., a locking ring 37, projecting radially on the second guide bolt 31, with slight biasing, such that the locking ring 37 contacts the upper contact face 33*b*. Therefore, the tool holder 15 is held in a home position or a first work position, as is shown in FIG. 3. If a sufficiently large additional compressive force acts from above on the horizontally oriented first leg 15*a* of the tool holder 15, the tool holder 15 shifts guided along the first guide bolt 27 against the spring force of the coil spring 35 downwardly. If the additional compressive force is taken away or if this becomes sufficiently small, the force of the coil spring 35 presses the tool holder 15 back upward into the original home position. The spring constant or the force of the coil spring 35 is dimensioned so that it can lift the tool holder 15 with the tool held therein—in the present example, this is the textile marker 5—without a problem quickly and reliably into the home position. According to the invention, the holding device 3 is constructed so that the movement of the needle bar 9 of the sewing machine 1, as performed during the sewing, can be used to move the tool holder 15 with the tool mounted therein in the described way. The tool holder 15 comprises a coupling device 39 that is constructed and arranged so that the needle bar 9 or another transmission element 41 constructed on the needle bar 9 or connected to this needle bar can transmit motion energy to the tool holder 15. In the illustrated example, the transmission element 41 is the bottom side of the needle holder 11. The coupling device 39 is constructed and arranged so that the transmission element 41 is coupled with the coupling device 39 during the execution of an up-and-down movement of the needle bar 9, as performed during sewing, at least in one section of this motion cycle, and thus allows the tool holder 15 to move according to the specified guide. In the case of a simple construction of the invention, the coupling device 39 could be constructed directly as a partial region of the first leg 15*a* of the tool holder 15, wherein the extended needle bar axis 8 intersects this partial region. Advantageously, the coupling device 39 comprises a shock absorber or an elastically resilient element, such as, e.g., a spring, in order to dampen or cushion the impacts of the needle bar 9 or the transmission element 41 held on this needle bar when contacting the first leg 15*a*.

Obviously, such a damping or spring element could be constructed alternatively also on the side of the needle bar 9 or on the transmission element 41. Such an elastic element could also simultaneously cause a springy or elastic pressing of the tool onto the sewing material to be processed.

The tool holder 15 comprises, adjacent to the first leg 15*a*, a second leg 15*b*. The two legs 15*a*, 15*b* enclose an angle 90°+, such that a textile marker 5 fixed axis-parallel on the second leg 15*b* is inclined at an inclination angle relative to the needle bar axis 8. Here, it is assumed that the needle bar axis 8 is oriented vertical to the surface of the stitch plate 17 or to the sheet material 44 or sewing material lying on this stitch plate. The inclination angle is greater than or equal to 0°. It could also equal, e.g., approximately 45° and advantageously lies in a range from approximately 30° to approximately 60°. The position or orientation of the second leg 15*b* relative to the first leg 15*a* can be specified fixed or alternatively could be set by a setting device (not shown) that can be adjusted continuously or in steps. Alternatively, a tool holder 15 could also be constructed so that, in a home position of the tool holder 15, the textile marker 5 or the tool lies passively on the sheet material 44 or is pressed onto this material, and is raised from the sheet material 44 by the action of the needle bar 9. After decoupling the needle bar 9 from the tool holder 15 (e.g., by pivoting the needle bar 9 by the zigzag drive into an orientation in which the transmission element 41 can no longer act on the coupling element 39 or alternatively by stopping the needle bar movement), the textile marker 5 is no longer raised from the sheet material 44 until the coupling with the needle bar 9 is reestablished. In this way, the tool can act continuously on the sheet material 44. Thus, with a textile marker 5, in addition to dot images, images with drawn-out lines could also be created.

In the case of another alternative construction of the invention, the tool holder 15 could also be connected in an articulated manner permanently or detachably to the needle bar 9 and/or the presser foot bar 23 (no illustration).

In the case of other alternative constructions of the invention, the tool holder 15 could also be constructed for attaching any other tools, such as, e.g., cutting blades, adhesive cartridges, or a laser for processing the material. Thus, in addition to passive tools, explicitly also active tools, such as lasers, shears operated by motors, and the like could also be used, which are supplied with energy, e.g., via a connection cable to the sewing machine controller and optionally controlled by the sewing machine controller. The tool holder 15 with the tool could be arranged and oriented advantageously in any position relative to the base part 19.

Figure 4:
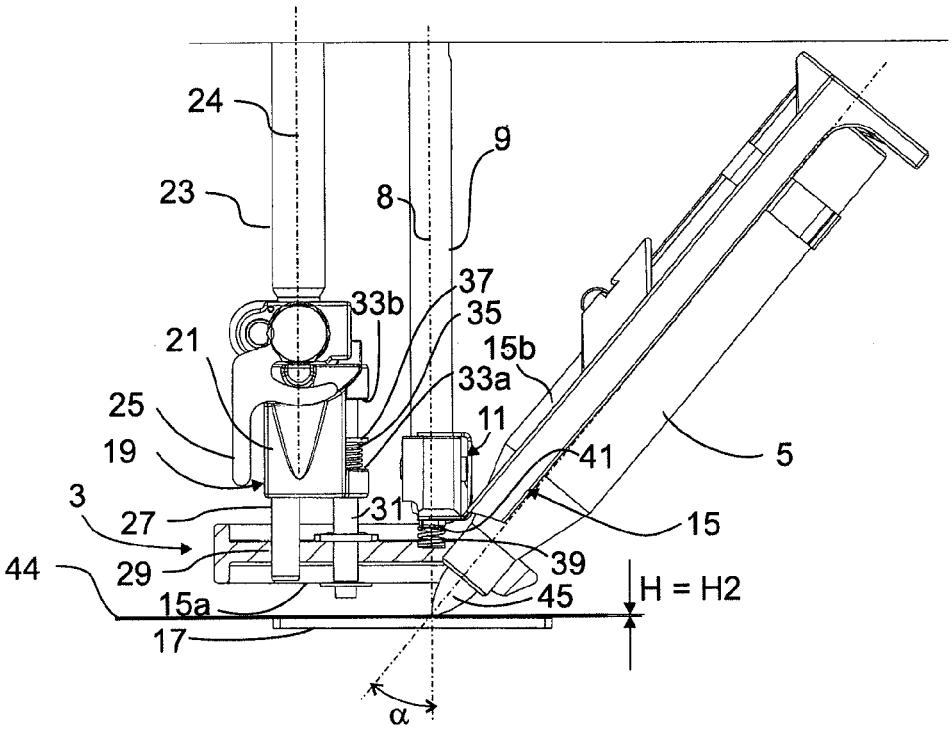
FIG. 4 is a view of the arrangement from FIG. 3, but in a second operating position.

In the case of the present example of a holding device 3 for a textile marker 5, an adjustment device (not shown) is advantageously provided that allows it to set the height of the marker tip 45 relative to the first leg 15*a*, e.g., by an adjustment screw. In this way, in the home position of the tool holder, the distance H=H1 or, in the case of a completely lowered needle bar 9, the distance H=H2 between the marker tip 45 and the stitch plate 17 could be specified. In the case of the completely lowered needle bar 9—this corresponds to a second work position and is shown in FIG. 4—the marker tip 45 could also lie on the stitch plate 17. The distance H=H2 is then equal to zero. In this region, with the adjustment device, the pressing force of the marker tip 45 against the stitch plate 17 can be set. If an sheet material 44 lies on the stitch plate 17, the contact force of the marker tip 45 on the sheet material 44 can be changed in an analogous way and adapted to the thickness and type of sheet material 44.

For orienting and fixing different textile pens 5 in a defined position on the tool holder 15, this holder can comprise, e.g., exchangeable inserts or adapters 47 and spring clamps 49. In FIG. 2, for example, a sleeve-like adapter 47 is shown in the region of the marker tip 45 and spring holding clips as the clamps 49 are shown in the rear region of the second leg 15*b*. On the rear end of the holding device 3, a stop is formed that prevents the textile pen 5 from being able to shift axially during operation. The stop could also be constructed spring-like and/or adjustable in its position. In this way, an adaptation to different textile pens 5 is possible.

Figure 5:
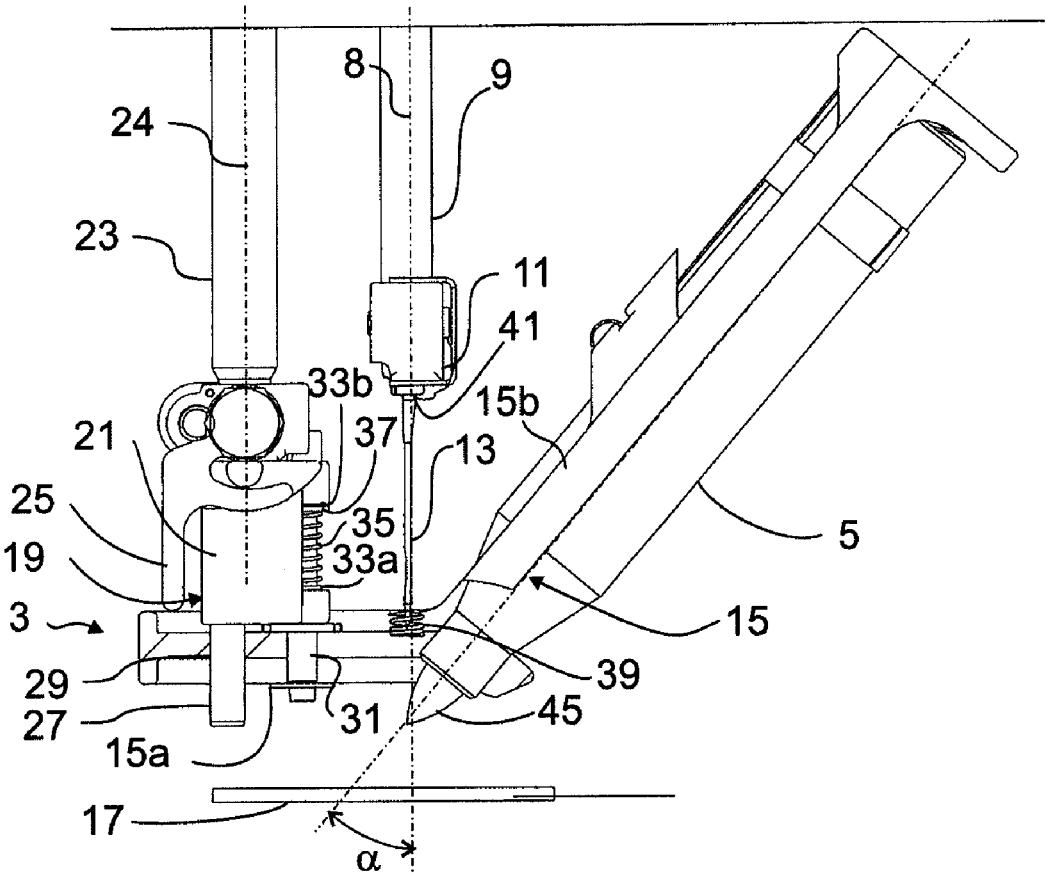
FIG. 5 is a view of the arrangement from FIG. 3, but with sewing needle attached to the needle bar.

FIG. 5 shows an arrangement according to FIG. 3, but with a sewing needle 13 inserted into the needle holder 11. If the sewing needle 13 is a compound sewing needle, in which none of the individual sewing needles 13 lie coaxial to the needle bar axis 8, then the marker tip 45 of the textile marker 5 can be arranged as shown in FIG. 5 without a radial offset relative to the extended needle bar axis 8. Otherwise, the tool holder 15 or the adapter could be constructed or oriented so that the marker tip 45 has, with respect to the needle bar axis 8, a radial offset that could lie on the order of magnitude of, e.g., approximately one millimeter up to, e.g., approximately 25 mm and that is optionally adjustable.

In the case of alternative constructions of the invention, the tool holder 15 or parts of this holder, such as, e.g., one or more adapters 47, could also be constructed for storing and fixing different tools instead of textile markers 5 (no illustration). Instead of or in addition to the vertical up-and-down movement of the needle bar 9, in the case of other constructions of the invention, a pivoting or oscillating movement of the needle bar 9 that could be generated by the zigzag drive of the sewing machine 1 could also be used to trigger or influence a movement or a different action of the tool held on the tool holder 15. In particular, a tool could comprise not only passive elements, but instead also active components, for example, a laser light source for the local heating of the sheet material 44 or a piezoelectric oscillation generator for a cutting blade (no illustration).

LEGEND OF REFERENCE SYMBOLS

1 Sewing machine
2 Circle line
3 Holding device
5 Textile marker
7 Machine head
8 Needle bar axis
9 Needle bar
11 Needle holder
13 Sewing needle
15 Tool holder
15*a* First leg
15*b* Second leg
17 Stitch plate
19 Base part
21 Presser foot shaft
23 Presser foot bar
24 Presser foot bar axis
25 Attachment lever
27 Guide bolt
29 Borehole
31 Second guide bolt
33*a* Lower contact face
33*b* Upper contact face
35 Coil spring
37 Locking ring
39 Coupling device
41 Transmission element
44 Sheet material
45 Marker tip
47 Adapter
49 Clamping means

The invention claimed is:

1. A holding device (3) for a tool for processing a textile or non-textile sheet material (44) for a sewing machine (1), comprising a presser foot shaft (21) formed on a base part (19) that is adapted to attach the holding device (3) to a presser foot bar (23) of the sewing machine (1), a tool holder (15) that receives the tool is located on the base part (19), and the tool holder (15) comprises a coupling device (39) that is contacted by a transmission element (11) on the needle bar (9) to move the tool to an active position.

2. The holding device (3) according to claim 1, wherein the tool holder (15) is constructed to store or hold a commercially available textile marker (5).

3. A holding device (3) for a tool for processing a textile or non-textile sheet material (44) for a sewing machine (1), comprising a presser foot shaft (21) formed on a base part (19) that is adapted to attach the holding device (3) to a presser foot bar (23) of the sewing machine (1), a tool holder (15) adapted to hold the tool is located on the base part (19), and the tool holder (15) comprises a coupling device (39) adapted for contact with a transmission element (11) on the needle bar (9), wherein the tool holder (15) is movably held on the base part (19), and the coupling device (39) is arranged and oriented on the tool holder (15) such that it can be moved by movement of the needle bar (9) when the holding device (3) is attached to the presser foot bar (23) of the sewing machine (1).

4. The holding device (3) according to claim 3, wherein the coupling device (39) comprises a shock absorber or an elastically flexible element.

5. The holding device (3) according to claim 1, wherein the tool holder (15) comprises a first leg (15*a*) and a second leg (15*b*), the first leg (15*a*) is supported on the base part (19) so that it can move, and the second leg (15*b*) is connected to the first leg (15*a*) with a fixed or adjustable inclination angle.

6. The holding device (3) according to claim 5, wherein the second leg (15*b*) comprises a detachable attachment device for connection of the tool in a specified position.

7. The holding device (3) according to claim 6, wherein the detachable attachment device for connection of the tool comprises exchangeable adapters (47).

8. The holding device according to claim 1, further comprising an adjustment mechanism that limits a range of movement or influences a relative position of the holding device.

9. A holding device (3) for a tool for processing a textile or non-textile sheet material (44) for a sewing machine (1), comprising a presser foot shaft (21) formed on a base part (19) that is adapted to attach the holding device (3) to a presser foot bar (23) of the sewing machine (1), a tool holder (15) adapted to hold the tool is located on the base part (19), and the tool holder (15) comprises a coupling device (39) adapted for contact with a transmission element (11) on the needle bar (9), wherein a guide bolt (27, 31) or a different, correspondingly linear guide element is constructed on at least one of the base part (19) or the tool holder (15) such that the tool holder (15) is supported on the base part (19) so that it can be shifted parallel to the presser foot axis (24) when the holding device (3) is attached to the presser foot bar (23) of the sewing machine (1), and the tool holder (15) is held on the base part (19) by a spring force from a spring in a home position or a first work position without action of additional forces.

10. A method for processing a textile or non-textile sheet material (44) with a tool on a sewing machine, comprising:

providing a holding device (3) for the tool having a presser foot shaft (21) formed on a base part (19) that is adapted to attach the holding device (3) to a presser foot bar (23) of the sewing machine (1), a tool holder (15) adapted to hold the tool is located on the base part (19), and the tool holder (15) comprises a coupling device (39) adapted for contact with a transmission element (11) on the needle bar (9);

attaching the tool to the presser foot bar (23) by connecting the holding device (3) to the presser foot bar and connecting the tool to the holding device: and moving the tool by an effect of the needle bar movement causing the transmission element to contact the coupling device during execution of an up-down movement of the needle bar.

* * * * *